US007190801B2

(12) United States Patent
Hsieh

(10) Patent No.: US 7,190,801 B2
(45) Date of Patent: Mar. 13, 2007

(54) HORN LOUDSPEAKER

(76) Inventor: Chen-Hugh Hsieh, No. 544, Min-Tsu Rd, Chia-I City, Taiwan (TW)

( * ) Notice: Subject to any disclaimer, the term of this patent is extended or adjusted under 35 U.S.C. 154(b) by 462 days.

(21) Appl. No.: 10/866,706

(22) Filed: Jun. 15, 2004

(65) Prior Publication Data

US 2005/0276432 A1 Dec. 15, 2005

(51) Int. Cl.
*H04R 25/00* (2006.01)
*G10K 11/00* (2006.01)

(52) U.S. Cl. ..... 381/341; 181/194

(58) Field of Classification Search ..... 181/152, 181/159, 177, 179, 183, 187, 189, 192, 193, 181/194; 381/337, 338, 339, 340, 341, 342, 381/343, 345, 396, 397, 398, 400, 420, 430
See application file for complete search history.

(56) References Cited

U.S. PATENT DOCUMENTS 5,637,840 A * 6/1997 Kim ..... 181/152
5,970,158 A * 10/1999 Beltran ..... 381/341
6,516,076 B1 2/2003 Marlin

* cited by examiner

*Primary Examiner*—Sinh Tran
*Assistant Examiner*—Brian Ensey
(74) *Attorney, Agent, or Firm*—Harness, Dickey & Pierce, P.L.C.

(57) ABSTRACT

A horn loudspeaker includes a horn housing having a top wall, an inner surrounding wall that extends downwardly from the top wall, a bottom wall that extends laterally and outwardly from the inner surrounding wall, and an outer surrounding wall that extends upwardly from the bottom wall. A cover has a top wall disposed over the top wall of the horn housing, and a surrounding wall that extends downwardly from the top wall of the cover into a gap between the inner and outer surrounding walls. Partitioning members are connected sealingly to the horn housing and the cover so as to define a plurality of sound channels thereamong. A sound-generating driver is adapted to be mounted in the horn housing for generating acoustic pressure wave which propagates through the sound channels.

8 Claims, 6 Drawing Sheets

HORN LOUDSPEAKER

BACKGROUND OF THE INVENTION

1. Field of the Invention

This invention relates to a horn loudspeaker, more particularly to a horn loudspeaker including a horn housing and a cover that cooperate to define a plurality of tortuous sound channels therebetween.

2. Description of the Related Art

FIG. 1 illustrates a conventional horn loudspeaker that is disclosed in U.S. Pat. No. 6,516,076 and that includes a driver housing 11 with a base wall 112, a sound-generating driver 10 mounted in the driver housing 11 and including a diaphragm 101 driven by a voice coil (not shown) and a magnet assembly 102, a horn housing 12 that defines a receiving space which receives the diaphragm 101 therein and that has an annular bottom end connected sealingly to the base wall 112 of the driver housing 11, and a cover 13 that covers and that cooperates with the horn housing 12 to define a plurality of sound channels 124 therebetween. A sound exit 123 is formed in a top wall 121 of the horn housing 12, and is in spatial communication with the receiving space in the horn housing 12 and the sound channels 124 so that acoustic pressure wave resulting from vibration of the diaphragm 101 can propagate through the sound exit 123 and into the sound channels 124, and then through a gap between a surrounding wall 122 of the horn housing 12 and a surrounding wall 113 of the driving housing 11 and into the atmosphere.

The aforesaid conventional horn loudspeaker is disadvantageous in that the sealing between the bottom end of the horn housing 12 and the base wall 112 of the driver housing 11 tends to have crevices, which can result in a leakage of pressure wave propagating therethrough. In addition, each of the sound channels 124 is formed with a substantially right angle between the bottom end of the horn housing 12 and the base wall 112 of the driver housing 11, which can result in undesired reflection of a considerable portion of pressure wave propagating therethrough, which, in turn, results in a significant attenuation loss of the pressure wave in the sound channels 124. Moreover, the assembly or detachment of the aforesaid conventional horn loudspeaker is laborious.

The entire disclosure of U.S. Pat. No. 6,516,076 is incorporated herein by reference.

SUMMARY OF THE INVENTION

The object of the present invention is to provide a horn loudspeaker that is capable of overcoming the aforesaid drawbacks associated with the prior art.

According to this invention, there is provided a horn loudspeaker that comprises: a horn housing defining a driver-receiving space that is adapted to receive a sound-generating driver therein, and having a top wall that is formed with a sound exit, an inner surrounding wall that extends downwardly from the top wall, a bottom wall that extends laterally and outwardly from the inner surrounding wall, and an outer surrounding wall that extends upwardly from the bottom wall and that is spaced apart from the inner surrounding wall to define a gap therebetween; a cover having a top wall that is disposed over the top wall of the horn housing, and a surrounding wall that extends downwardly from the top wall of the cover into the gap; and a plurality of spaced apart partitioning members disposed between and connected sealingly to the horn housing and the cover so as to define a plurality of sound channels thereamong. Each of the sound channels diverges from the sound exit in the horn housing so that the acoustic pressure wave resulting from the sound-generating driver can propagate through the sound exit in the horn housing and into the sound channels.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
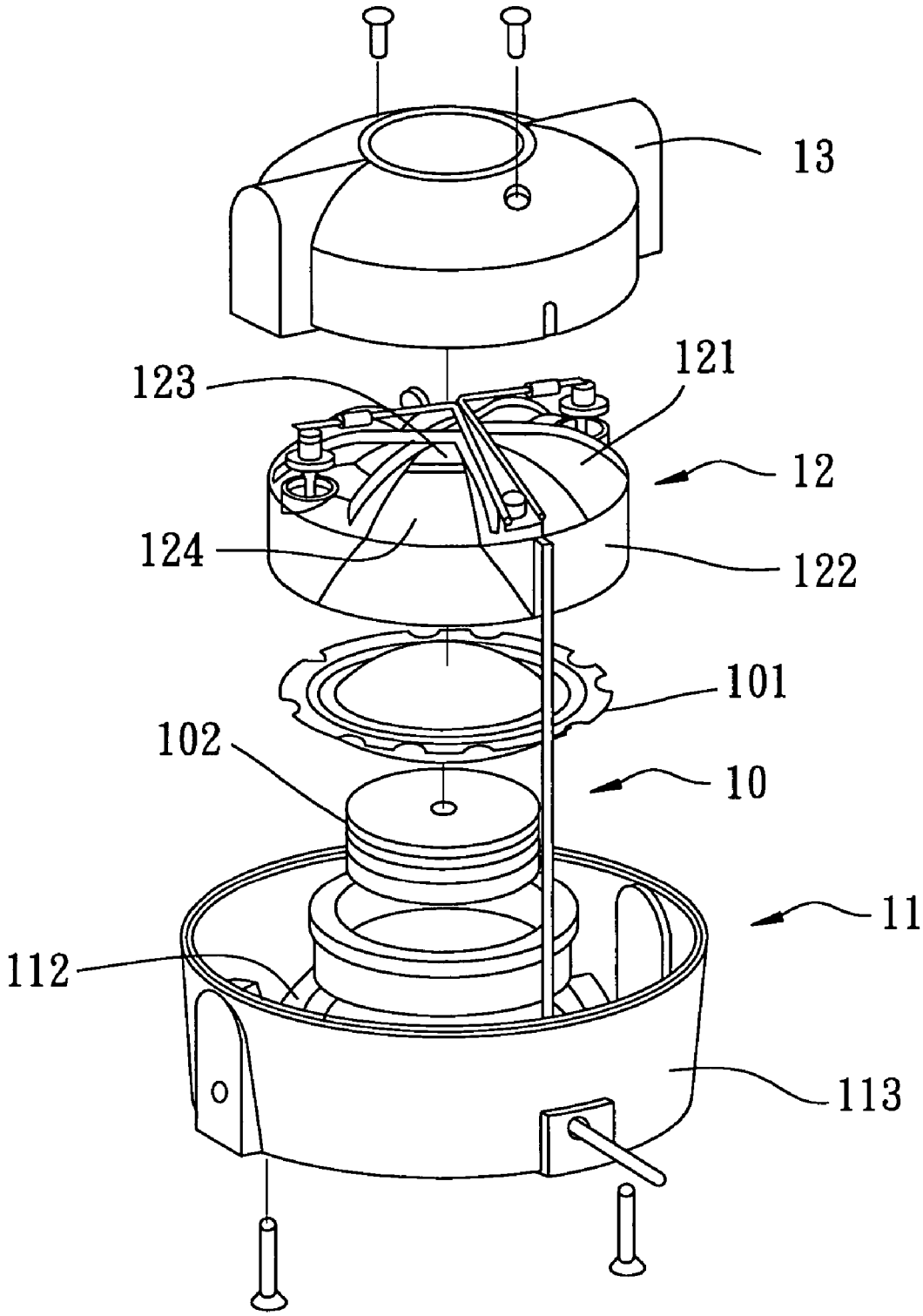
FIG. 1 PRIOR ART
FIG. 1 is an exploded perspective view of a conventional horn loudspeaker.
Figure 2:
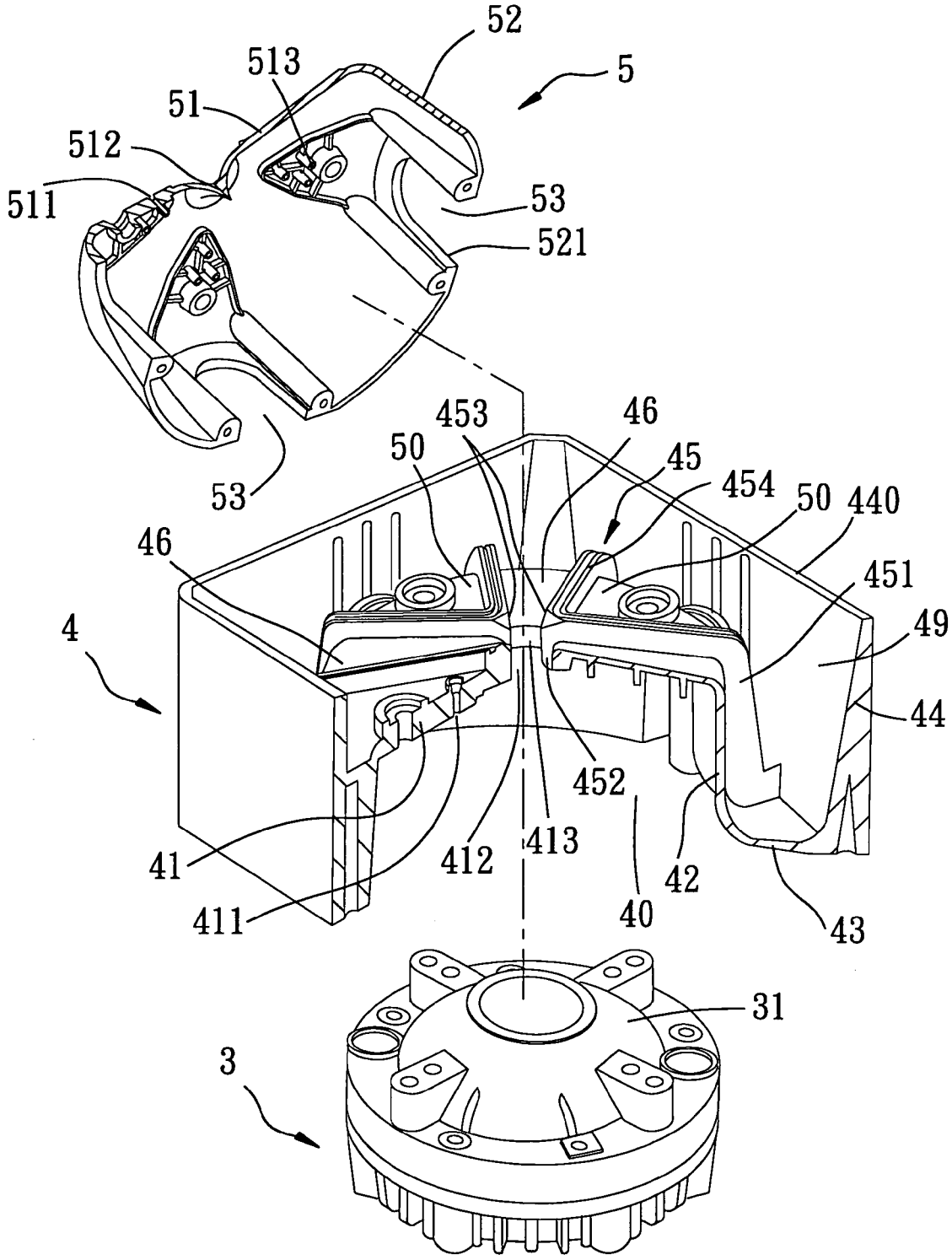
FIG. 2 is an exploded fragmentary perspective view of the preferred embodiment of a horn loudspeaker.
Figure 3:
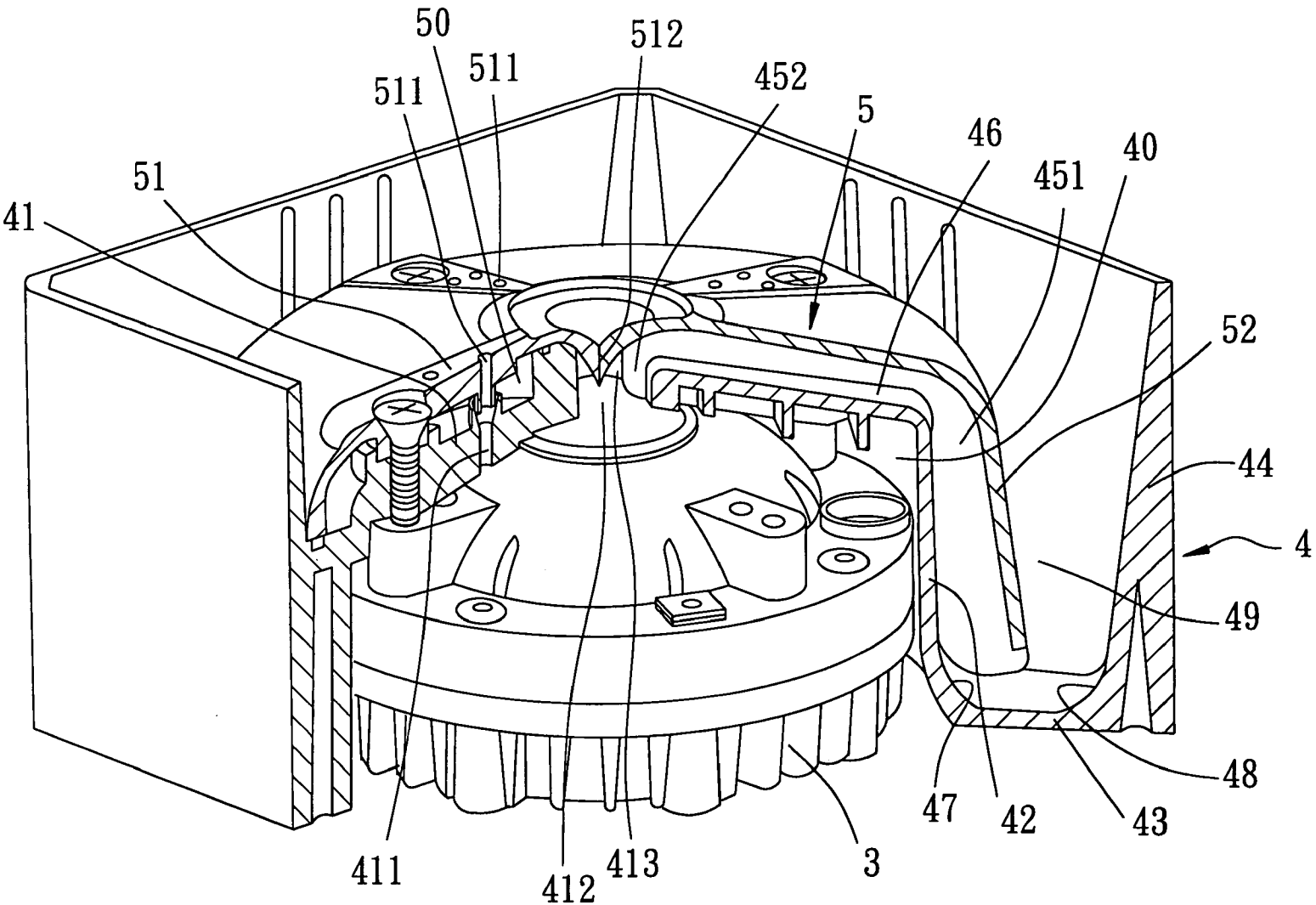
FIG. 3 is a cutaway view of the preferred embodiment of this invention.
Figure 4:
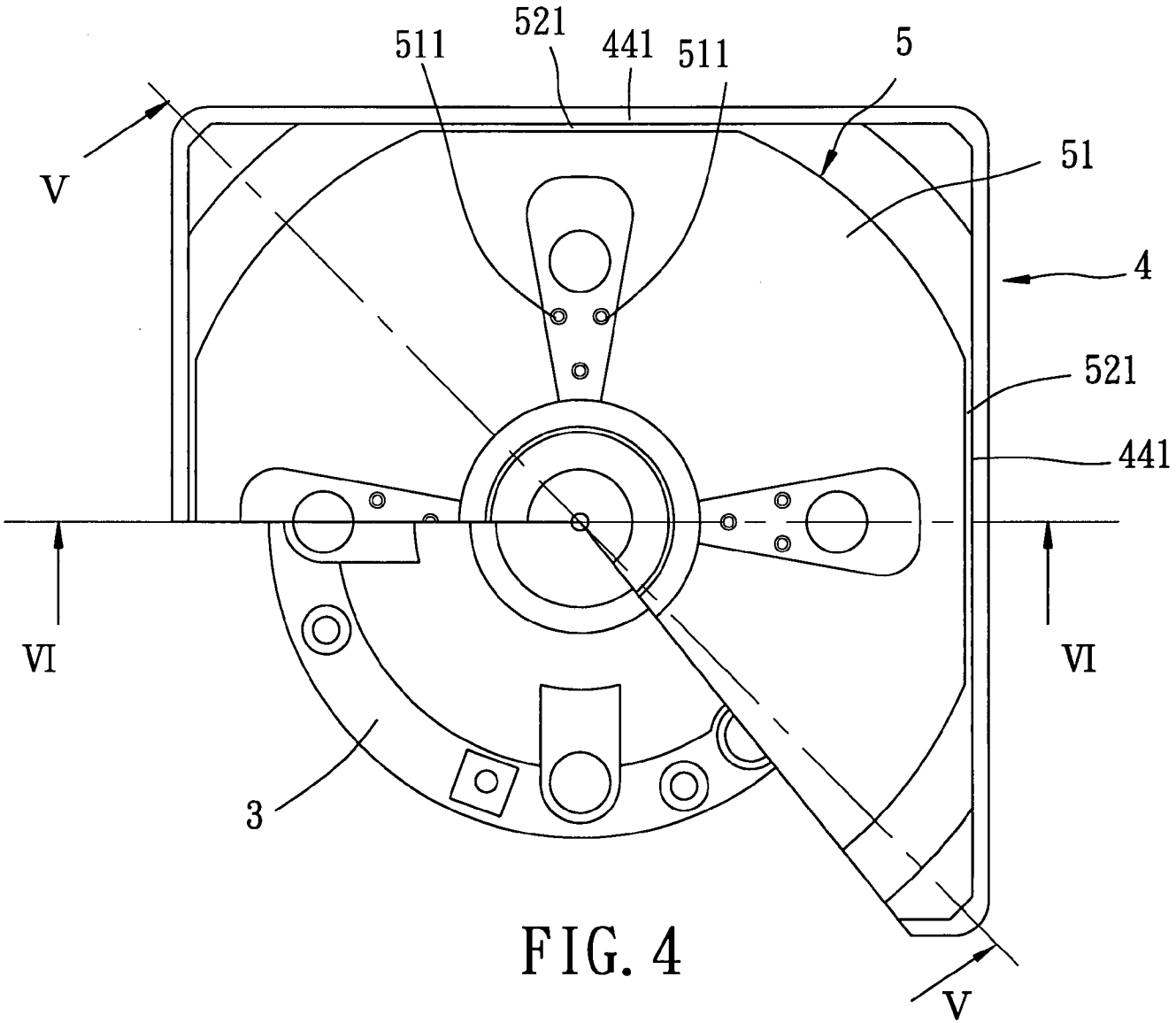
FIG. 4 is a top view of FIG. 3.
Figure 5:
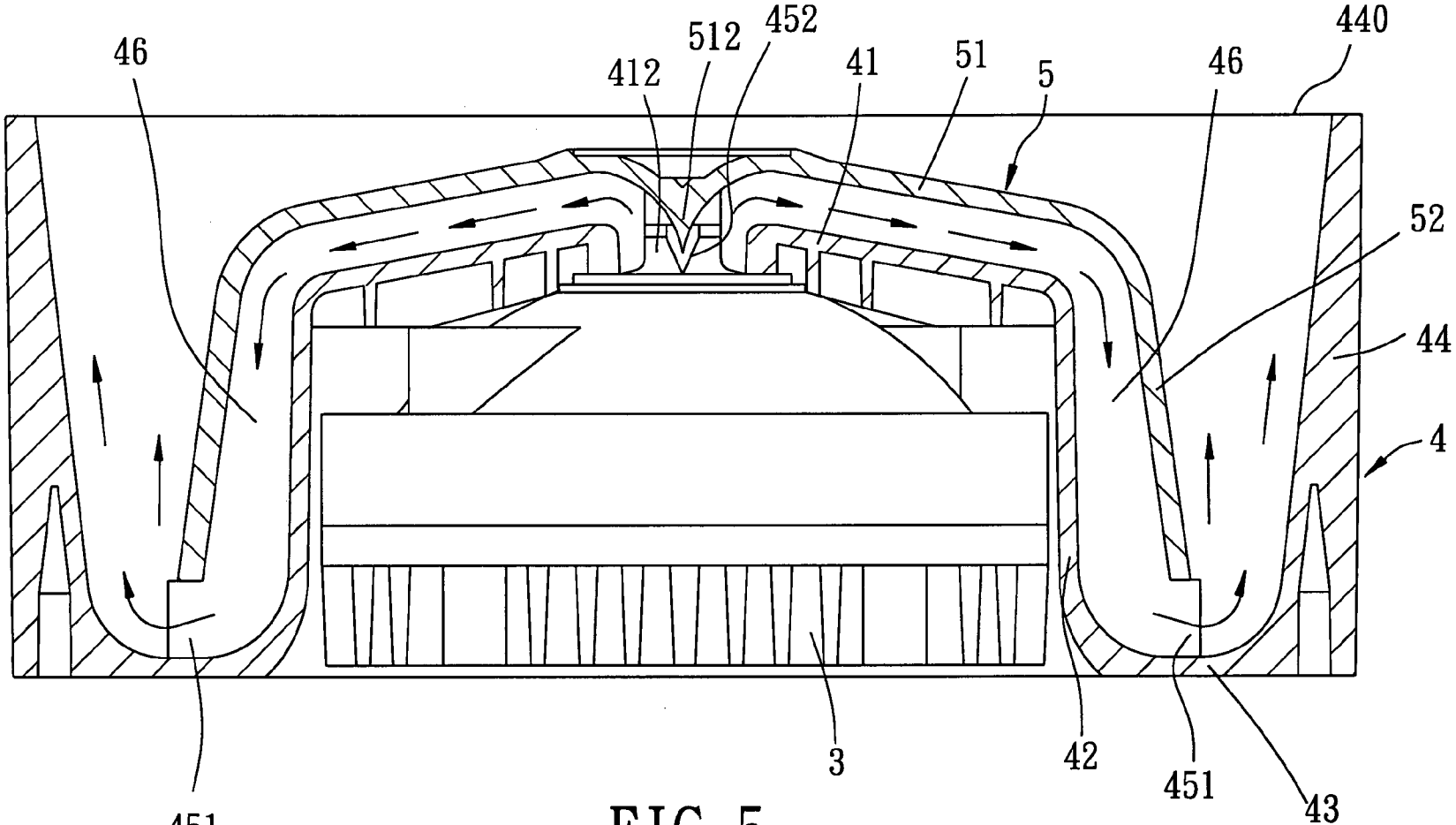
FIG. 5 is a sectional view taken along lines V—V in FIG. 4.
Figure 6:
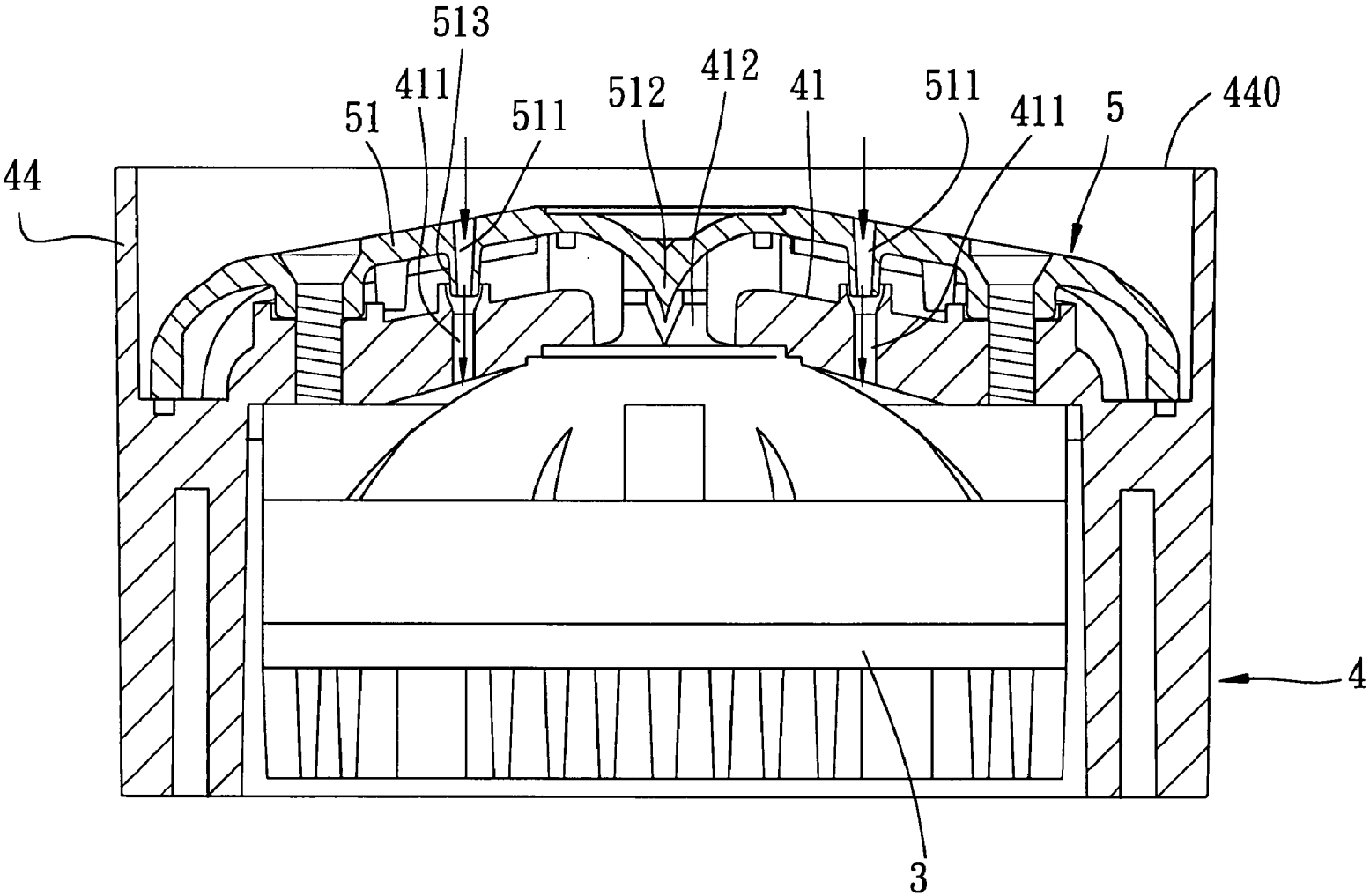
FIG. 6 is a sectional view taken along lines VI—VI in FIG. 4.

FIGS. 2 to 6 illustrate the preferred embodiment of a horn loudspeaker according to the present invention.

The horn loudspeaker includes: a horn housing 4 defining a driver-receiving space 40 therein, and having a top wall 41 that is formed with a sound exit 412, an inner surrounding wall 42 that extends downwardly from the top wall 41, a bottom wall 43 that extends laterally and outwardly from the inner surrounding wall 42, and an outer surrounding wall 44 that extends upwardly from the bottom wall 43 and that is spaced apart from the inner surrounding wall 42 to define a gap 49 therebetween; a cover 5 having a top wall 51 that is disposed over the top wall 41 of the horn housing 4, and a surrounding wall 52 that extends downwardly from the top wall 51 of the cover 5 into the gap 49; a plurality of spaced apart partitioning members 45 disposed between and connected sealingly to the horn housing 4 and the cover 5 so as to define a plurality of sound channels 46 thereamong, each of the sound channels 46 diverging from the sound exit 412 in the horn housing 4 to an open end 440 defined by the outer surrounding wall 44 of the horn housing 4; and a sound-generating driver 3 mounted in the driver-receiving space 40 for generating acoustic pressure wave which propagates through the sound exit 412 in the horn housing 4 and into the sound channels 46 and then through the open end 440 defined by the outer surrounding wall 44 of the horn housing 4 and into the free space of the atmosphere.

In this embodiment, the inner surrounding wall 42 and the bottom wall 43 of the horn housing 4 cooperatively define a curved inner corner 47 therebetween, and the bottom wall 43 and the outer surrounding wall 44 of the horn housing 4 cooperatively define a curved outer corner 48 therebetween. Each of the sound channels 46 has lower corner portions that are respectively contoured by the inner and outer corners 47, 48 so as to guide smoothly the pressure wave propagating therethrough and so as to eliminate or reduce the extent of undesired reflection of the pressure wave in the sound channels 46.

Each of the partitioning members 45 includes a pair of partitioning ribs 451 that are joined together at a periphery of the sound exit 412 to define a tip end 453 of the partitioning members 45 and that diverge therefrom toward the outer surrounding wall 44 of the horn housing 4. Each of the partitioning ribs 451 of each of the partitioning members 45 is provided with a sealing member 454 that is connected sealingly to the top wall 51 of the cover 5.

The horn housing 4 has an exit-defining wall 413 that defines the sound exit 412. Each of the partitioning members 45 has a bottom protrusion 452 that extends downwardly from the tip end 453 of the partitioning member 45 and that is formed on and that protrudes from the exit-defining wall 413 of the horn housing 4 into the sound exit 412. The cover 5 is formed with a conical protrusion 512 that protrudes into the sound exit 412 so as to reduce the cross-section of the sound exit 412 and so as to enhance compression of the pressure wave, which is generated through vibration of a diaphragm 31 of the sound-generating driver 3, in the sound exit 412.

The partitioning members 45 further cooperate with the top wall 51 of the cover 5 and the top wall 41 of the horn housing 4 to define a plurality of ventilating spaces 50, each of which is disposed between two adjacent ones of the sound channels 46. The top wall 51 of the cover 5 is formed with a plurality of vent posts 513, each of which defines a vent hole 511 therein and each of which extends downwardly from the top wall 51 of the cover 5 into a respective one of the ventilating spaces 50 and to the top wall 41 of the horn housing 4. The top wall 41 of the horn housing 4 is formed with a plurality of vent holes 411, each of which is registered with the vent hole 511 in a respective one of the vent posts 513 and each of which is in fluid communication with the driver-receiving space 40 and the vent hole 511 in the respective one of the vent posts 513 so as to enhance the cooling effect on the sound-generating driver 3.

Preferably, the inner surrounding wall 42 of the horn housing 4 is circular in shape, whereas the outer surrounding wall 44 of the horn housing 4 is rectangular in shape. The surrounding wall 52 of the cover 5 has four sides 521 (see FIG. 4) that confront respectively four sides 441 of the outer surrounding wall 44 of the horn housing 4. Each of the four sides 521 of the surrounding wall 52 of the cover 5 is formed with an opening 53.

By forming integrally the inner surrounding wall 42 and the outer surrounding wall 44 with the bottom wall 43 and by virtue of the curved inner and outer corners 47, 48 defined by the bottom wall 43 of the horn housing 4 and the inner and outer surrounding walls 42, 44, the aforesaid drawbacks associated with the prior art can be eliminated. Moreover, by virtue of the rectangular shape of the outer surrounding wall 44 of the horn housing 4, the size of the horn loudspeaker can be reduced as compared to the aforesaid conventional horn loudspeaker.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A horn loudspeaker comprising:

a horn housing defining a driver-receiving space that is adapted to receive a sound-generating driver therein, and having a top wall that is formed with a sound exit, an inner surrounding wall that extends downwardly from said top wall, a bottom wall that extends laterally and outwardly from said inner surrounding wall, and an outer surrounding wall that extends upwardly from said bottom wall and that is spaced apart from said inner surrounding wall to define a gap therebetween;

a cover having a top wall that is disposed over said top wall of said horn housing, and a surrounding wall that extends downwardly from said top wall of said cover into said gap; and a plurality of spaced apart partitioning members disposed between and connected sealingly to said horn housing and said cover so as to define a plurality of sound channels thereamong, each of said sound channels diverging from said sound exit in said horn housing so that the acoustic pressure wave resulting from the sound-generating driver can propagate through said sound exit in said horn housing and into said sound channels.

2. The horn loudspeaker of claim 1, wherein said inner surrounding wall and said bottom wall of said horn housing cooperatively define a curved inner corner thererbetween.

3. The horn loudspeaker of claim 2, wherein said bottom wall and said outer surrounding wall of said horn housing cooperatively define a curved outer corner therebetween, each of said sound channels having lower corner portions that are respectively contoured by said inner and outer corners.

4. The horn loudspeaker of claim 1, wherein said horn housing has an exit-defining wall that defines said sound exit, each of said partitioning members having a bottom protrusion that is formed on and that protrudes from said exit-defining wall of said horn housing into said sound exit.

5. The horn loudspeaker of claim 1, wherein said cover is formed with a conical protrusion that protrudes into said sound exit.

6. The horn loudspeaker of claim 1, wherein said partitioning members further cooperate with said top wall of said cover and said top wall of said horn housing to define a plurality of ventilating spaces, each of which is disposed between two adjacent ones of said sound channels, said top wall of said cover being formed with a plurality of vent posts, each of which defines a vent hole therein, and each of which extends downwardly from said top wall of said cover into a respective one of said ventilating spaces to said top wall of said horn housing, said top wall of said horn housing being formed with a plurality of vent holes, each of which is registered with said vent hole in a respective one of said vent posts and each of which is in fluid communication with said driver-receiving space and said vent hole in the respective one of said vent posts.

7. The horn loudspeaker of claim 1, wherein said inner surrounding wall of said horn housing is circular in shape, and said outer surrounding wall of said horn housing is rectangular in shape.

8. The horn loudspeaker of claim 1, wherein each of said partitioning members is provided with a sealing member that is connected sealingly to said top wall of said cover.

* * * * *